US005226642A

United States Patent [19]

Ganter

[11] Patent Number: 5,226,642

[45] Date of Patent: Jul. 13, 1993

[54] DELIVERY PILE AT A PRINTING MACHINE

[75] Inventor: Udo Ganter, Hirschberg-Leutershausen, Fed. Rep. of Germany

[73] Assignee: Heidelberger Druckmaschinen Aktiengesellschaft, Heidelberg, Fed. Rep. of Germany

[21] Appl. No.: 850,198

[22] Filed: Mar. 11, 1992

[30] Foreign Application Priority Data

Mar. 11, 1991 [DE] Fed. Rep. of Germany ... 9102883[U]

[51] Int. Cl.[5] ..... B65H 31/36

[52] U.S. Cl. ..... 271/222; 271/217

[58] Field of Search ..... 271/180, 217, 218, 221, 271/222

[56] References Cited

U.S. PATENT DOCUMENTS

| | | | |
|---|---|---|---|
| 2,992,823 | 7/1961 | Forrester | 271/222 |
| 3,703,283 | 11/1972 | Abendroth et al. | 271/222 |
| 5,060,929 | 10/1991 | Kohlmann | 271/222 |

FOREIGN PATENT DOCUMENTS

| | | | |
|---|---|---|---|
| 288814 | 11/1988 | European Pat. Off. | 271/217 |
| 2942965 | 5/1981 | Fed. Rep. of Germany . | |
| 2308576 | 11/1976 | France | 271/221 |
| 472024 | 9/1937 | United Kingdom | 271/221 |

*Primary Examiner*—H. Grant Skaggs

*Attorney, Agent, or Firm*—Nils H. Ljungman

[57] ABSTRACT

Apparatus for forming a sheet delivery pile in a printing press, the apparatus including a sheet receiving surface for the formation thereon of the sheet delivery pile, a rotatable shaft, a sheet stop member attached to the rotatable shaft and extending along the leading edge of the sheet delivery pile, a lever member attached to the rotatable shaft, an oscillation device for reciprocally oscillating the rotatable shaft between a first position wherein the sheet stop member is in contact with the leading edge of the sheet delivery pile and a second position wherein the sheet stop member is out of contact with the leading edge of the sheet delivery pile, and a biasing arrangement for biasing the sheet stop member in a direction from the second position and towards the first position.

20 Claims, 3 Drawing Sheets

II
2
10
17
15
9
16
8
6
11
7
5
4
1'
1
1'
18
14
35
37
3
12
13
21
20
23
19
31
25
27
26
22
30
28
29
24
II

DELIVERY PILE AT A PRINTING MACHINE

BACKGROUND OF THE INVENTION

1. Field of the Invention

The present invention relates to an apparatus for forming a sheet delivery pile in the sheet delivery area of a printing press, the sheet delivery area of the printing press being provided with a device for raising and/or lowering the sheet delivery pile and with sheet front stops that are provided in the sheet-feeding direction and which are moved to and fro for aligning and jogging the sheets that are delivered there, thereby forming an exactly aligned forward (or leading) edge of the delivery pile.

2. Background Information

German Published Application No. 29 42 965 Al shows an apparatus in which sheet stops are designed to perform a jogging movement, the sheet stops being periodically moved to and fro by means of electromagnets. Some of the disadvantages of such controlled jogging means are that they cause noise and that, when using delicate papers, they may damage the leading edges of the sheets. Moreover, they limit the accessibility to the sheet pile, so that it may be difficult for the pressman to pull out sample sheets therefrom.

OBJECT OF THE INVENTION

An object of the present invention is to provide an improved alignment apparatus for a sheet delivery pile to avoid any damage to the sheet edges.

SUMMARY OF THE INVENTION

According to the invention, the above-mentioned objective is achieved in that, by means of an eccentric cam and a control lever, the sheet stops are pulsatingly lifted from the leading edge of the delivery pile by means of a pressure spring. Such a solution is relatively noiseless and ensures a soft and exact aligning of the sheets, due to the fact that the sheet stops are in resilient contact with the leading pile edge.

In order to be able to adapt the pressure of the sheet stops to different types and weights of paper, and especially to delicate papers, the pressure spring bias is preferably made adjustable via adjusting means, either manually or by means of a motor. When printing, for example, on heavy cardboard, the bias can be increased, so as to ensure a very exact alignment of the sheets. Very thin and light papers require, on the other hand, a reduced amount of bias, in order to avoid damage to the sheets. A cylinder actuated by a pressure medium is preferably provided to arrest the sheet stops, so that, for example, an intermediate piling device which is optionally employed may be easily pulled out.

One aspect of the invention resides broadly in an apparatus for forming a sheet delivery pile at a sheet delivery area of a printing press, the sheet delivery area having sheets delivered thereto sequentially along a line of transport by the printing press, the apparatus comprising: sheet receiving surface apparatus, the sheet receiving surface apparatus being positioned along the line of transport of the delivered sheets, the sheet receiving apparatus device being for the formation thereon of the sheet delivery pile, the sheet receiving surface apparatus and the sheet delivery pile each having a leading edge positioned along the line of transport of the delivered sheets; a shaft, the shaft having an elongated axis which extends along the leading edge of the sheet delivery pile formed on the sheet receiving surface apparatus;

at least one sheet stop member attached to and extending from the shaft and along the leading edge of the sheet delivery pile formed on the sheet receiving surface apparatus;

a lever member attached to the shaft;

oscillation apparatus for reciprocally oscillating the lever member about the elongated axis of the shaft, and along the line of transport of the delivered sheets, between a first position wherein the at least one sheet stop member is positioned in contact with the leading edge of the sheet delivery pile, and a second position wherein the at least one sheet stop member is positioned out of contact with the leading edge of the sheet delivery pile; and biasing apparatus for biasing the at least one sheet stop member in a direction from the second position wherein the sheet stop member is out of contact with the leading edge of the sheet delivery pile and towards the first position wherein the at least one sheet stop member is in contact with the leading edge of the sheet delivery pile.

Another aspect of the invention apparatus for forming a delivery pile at a sheet delivery area of a printing press, the sheet delivery area having sheets delivered thereto sequentially along a line of transport by the printing press, the apparatus comprising:

sheet receiving surface apparatus, the sheet receiving surface apparatus having a sheet receiving surface positioned within a plane and along the line of transport of the delivered sheets;

at least one sheet stop, the at least one sheet stop comprising a sheet stop member extending transversely to the plane within which the sheet receiving surface is positioned, the sheet stop member being displaceable along the line of transport between a first position wherein the sheet stop member is adjacent the sheet receiving surface and a second position wherein the sheet stop member is distanced from the sheet receiving surface;

apparatus for oscillating the sheet stop member between the first position and the second position; and biasing apparatus for biasing the sheet stop member along the line of transport in a direction from the second position and towards the first position.

We turn now to a detailed description of a preferred embodiment of the invention, after first briefly describing the accompanying drawings.

DESCRIPTION OF THE PREFERRED EMBODIMENTS

Figure 1:
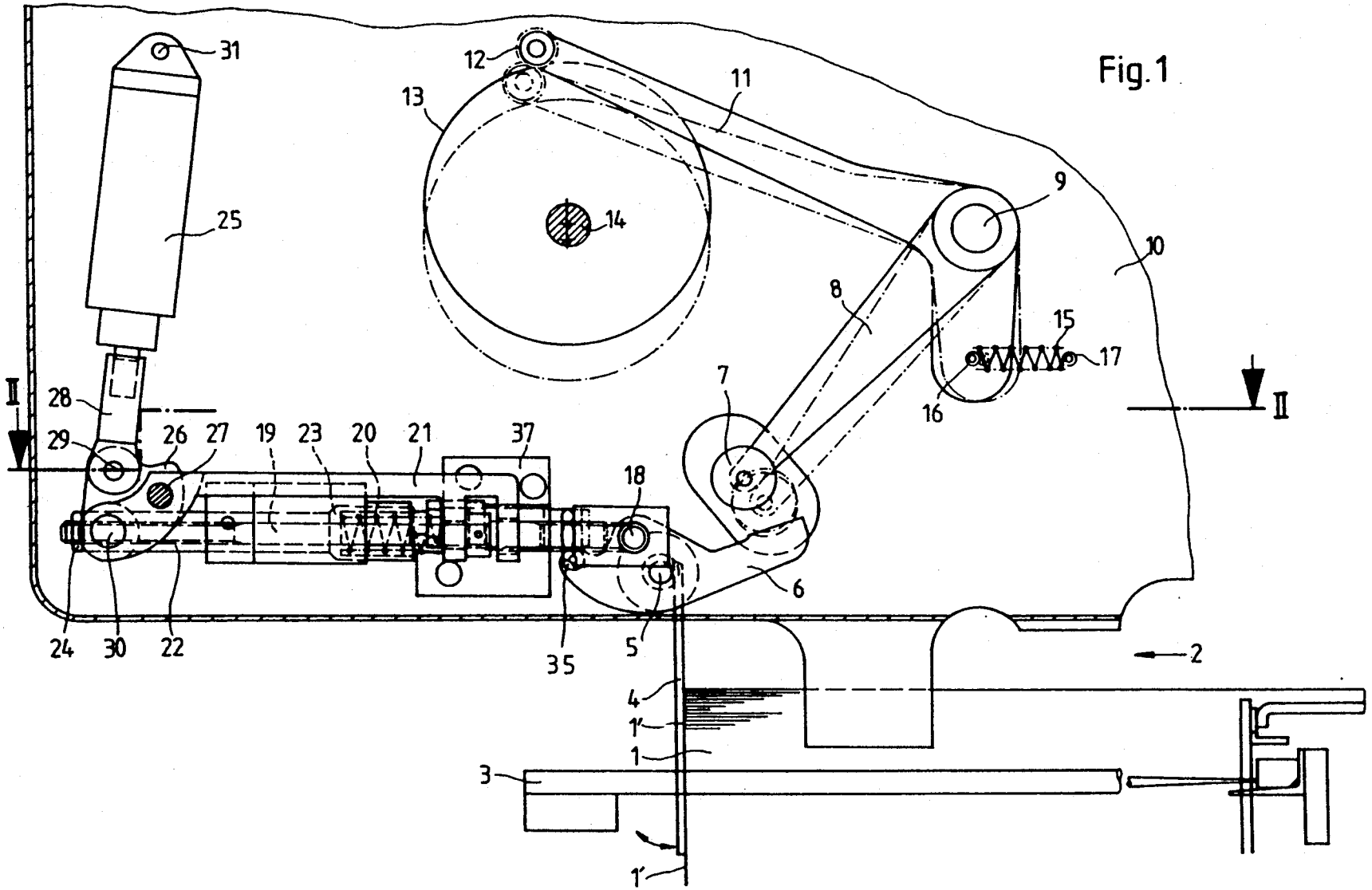
FIG. 1 is a side elevational view of the delivery pile area of a printing press which is provided with controlled sheet stops according to the invention.

FIG. 1 shows a sheet delivery pile 1, the height of which is increased by the delivery of printed sheets supplied by the printing press from the direction indicated by an arrow 2. The delivery pile 1 is preferably provided with a pile raising and/or lowering device which maintains the top edge of the pile at a certain level. Moreover, there is shown in FIG. 1 an intermediate piling device 3. Sheet stops 4 fastened to a spindle 5 are provided in the front area of the delivery pile 1. The spindle 5 is rotatably mounted in the side frames so that the sheet stops 4 may execute an oscillating reciprocating motion and may abut against the leading edge 1' of the delivery pile 1, when the sheet stops are in a working position.

The intermediate piling device 3 is preferably essentially a grate which may be inserted into the sheet delivery area such that it is supported over an already formed pile of delivered sheets. Additional delivered printed sheets then form a temporary pile on top of the grate, which allows the primary delivery pile 1 to be lowered and removed from the delivery area of the printing press. The raising and/or lowering apparatus may then be employed to raise, for example, a new empty pallet to a position immediately beneath the intermediate piling device 3 (e.g., the grate), which may then be removed, allowing the temporary pile to rest on the new pallet. Such intermediate piling devices are well known in the printing press art and are discussed for example in U.S. Pat. No. 5,090,681, issued on Feb. 25, 1992 and entitled "Sheet Processing Machine", and in U.S. Pat. No. 4,799,847 entitled "Sheet Stacker".

For driving of the spindle 5, the spindle 5 is provided with a lever 6, a roller 7, which is fastened to a control lever 8, being in contact with the lever 6. The control lever 8 is pivotally mounted on a bolt 9, which is in turn fastened to a machine side frame 10 (e.g., a side frame of the printing press or other suitable mounting structure). A cam roller 12, which runs on an eccentric cam 13, is mounted on an angle bracket 11. The eccentric cam 13 is also preferably mounted on the machine side frame via a rotatably driven drive shaft 14. A draw spring 15, which is hooked to a first eye 16 provided on the control lever 8 and to a second eye 17 provided on the side frame 10, ensures that the cam roller 12 maintains contact with the eccentric cam 13.

Figure 2:
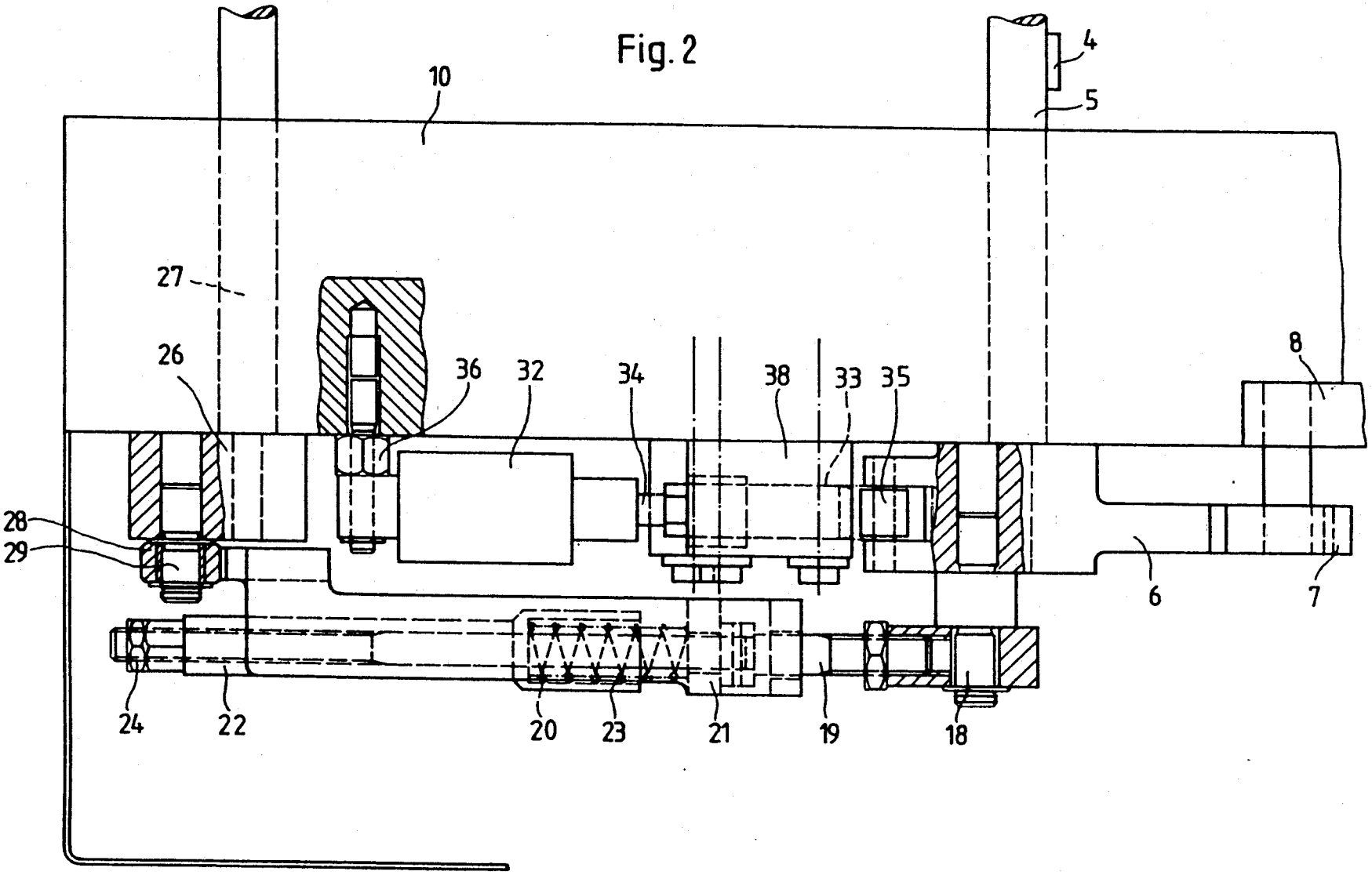
FIG. 2 is a partial cross-sectional view of an associated control system.

Referring to FIGS. 1 and 2, via a pin 18, a spring rod 19 engages the lever 6, a pressure spring 20 being provided on the spring rod 19. The pressure spring 20 is supported, on one side thereof, by an adjusting means 21, and on the other side thereof, the pressure spring 20 is held in a sleeve 22 mounted on the spring rod 19. The sleeve 22 can be axially displaced on the spring rod 19 via a bushing 23 and an adjusting nut 24, so that the pressure spring 20 can be tensioned to varying degrees.

When pulling out sample sheets, provision is made for swinging the sheet stops 4 away from the delivery pile 1. For this purpose, there is provided a pneumatic cylinder 25 which, via a piston rod 28 and a pin 29, acts on a swivelable member 26, the swivelable member 26 being pivotally mounted, preferably on the machine side frame 10, via a bolt 27. Furthermore, the swivelable member 26 is connected to the adjusting means 21 via a further pin 30 such that, when actuating the pneumatic cylinder 25 via the adjusting means 21, the spring rod 19 and the pressure spring 20 are moved to the right to such an extent (without changing the set spring bias) that the lever 6 swivels the spindle 5 with the sheet stops 4, thus permitting the removal of sample sheets from the delivery pile 1 for inspection. The pneumatic cylinder 25 is also preferably supported on the side frame 10 via a bolt 31.

Figure 3:
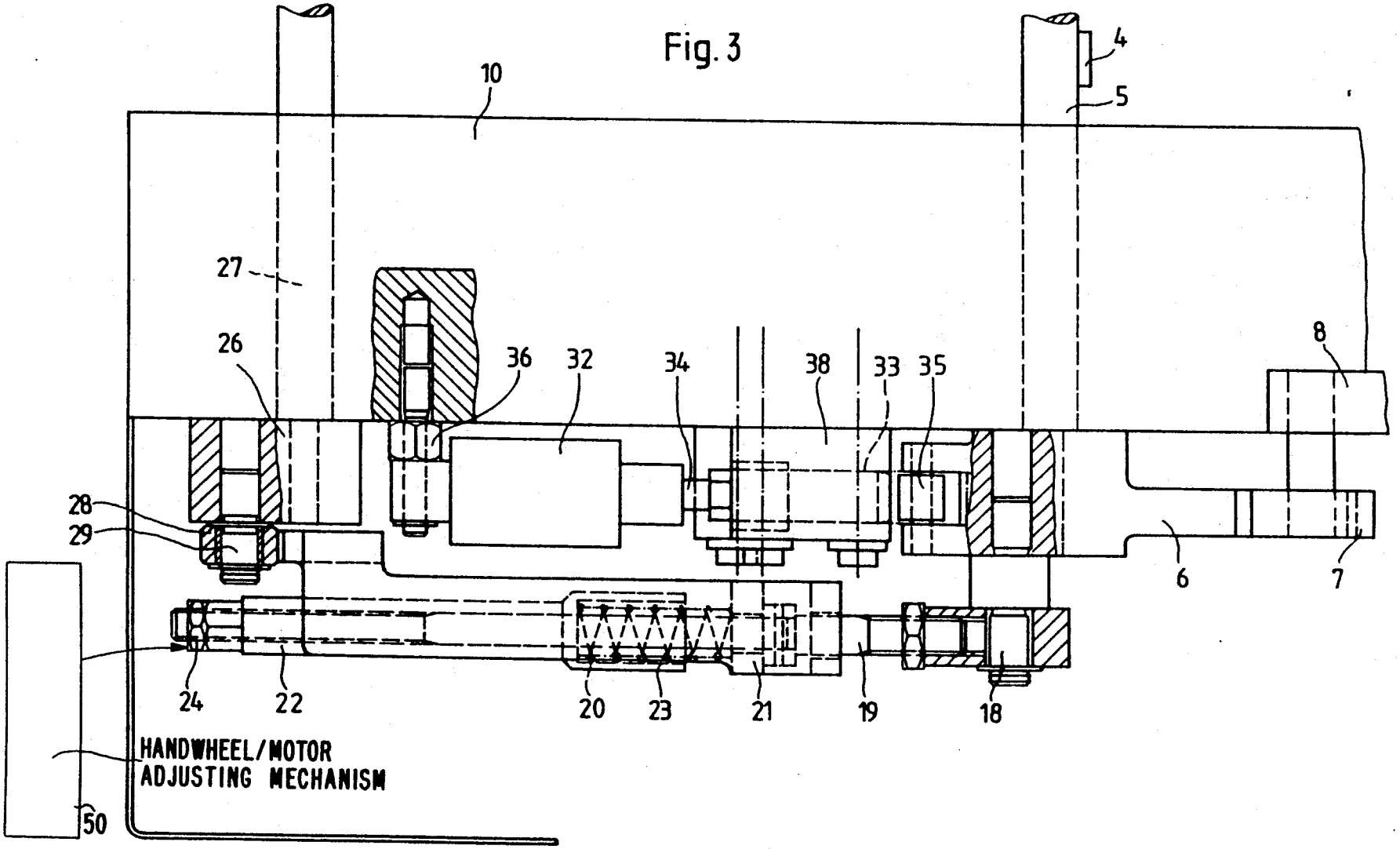
FIG. 3 is similar to FIG. 2, but illustrates alternative embodiments wherein a handwheel adjusting mechanism and a motor driven adjusting mechanism are employed.

The pressure spring 20 is adjustable via the adjusting nut 24 provided on the spring rod 19 as well as via optional manual adjusting means 50, as shown in FIG. 3, as for example, by means well known in the art, via a handwheel. The pressure spring bias can also be motor-adjusted, for example, via an adjusting motor, also indicated by reference numeral 50 in FIG. 3, which acts on the spring rod 21 via an adjusting mechanism. The provision of such an adjusting motor without undue experimentation is well known to those of ordinary skill in the mechanical arts.

As is shown most clearly in FIG. 2, for the purpose of arresting the sheet stops 4 when, for example, pulling out the intermediate piling device 3, there is provided a pressure-medium actuated cylinder 32 which, via a pin 33, and an extension of the piston rod 34, arrests a roller 35 provided on the lever 6. The cylinder 32 is preferably supported on a bolt 36 anchored on the machine side frame 10. A pin 33 is mounted in a bearing 37 which is also fastened to the machine side frame 10.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

| REFERENCE NUMERALS | |
|---|---|
| 1 | delivery pile |
| 1' | leading edge of pile |
| 2 | direction of arrow |
| 3 | intermediate piling device |
| 4 | sheet stop |
| 5 | spindle |
| 6 | lever |
| 7 | roll |
| 8 | control level |
| 9 | bolt |
| 10 | side frame |
| 11 | angle bracket |
| 12 | cam roller |
| 13 | eccentric |
| 14 | drive shaft |
| 15 | draw spring |
| 16 | eye |
| 17 | eye |
| 18 | pin |
| 19 | spring rod |
| 20 | pressure spring |
| 21 | adjusting means |
| 22 | sleeve |
| 23 | bushing |
| 24 | adjusting nut |
| 25 | pneumatic cylinder |
| 26 | swivel means |
| 27 | bolt |
| 28 | bearing |
| 29 | pin |
| 30 | pin |
| 31 | bolt |
| 32 | cylinder |
| 33 | pin |
| 34 | piston rod |
| 35 | roll |
| 36 | bolt |

-continued

| REFERENCE NUMERALS |
| --- |
| 37 bearing |

What is claimed:

1. Apparatus for forming a sheet delivery pile at a printing machine from sheets delivered thereto, the sheets for being delivered in a sheet feeding direction to the pile, said apparatus comprising:

a piling device for vertically transporting the pile of delivered sheets;

sheet stops being configured to face in the sheet feeding direction, for arresting the delivery of sheets;

means for moving said sheet stops back and forth for aligning and jogging the delivered sheets;

said means for moving said sheet stops comprising means for forming an exact leading pile edge of the delivered sheets;

a spindle, said sheet stops being mounted on said spindle;

cam means comprising an eccentric cam and a control lever being operably engageable with said eccentric cam;

said control lever being operably engageable with said spindle;

a pressure spring for providing a biasing force and biasing said sheet stops against the leading pile edge of the delivered sheets;

said sheet stops having a rest position, wherein said sheet stops are configured for being oriented towards the leading pile edge of the delivered sheets in the rest position, said sheet stops being configured for being biased towards the leading pile edge of the delivered sheets when in the rest position;

said cam means being configured for pulsatingly moving said sheet stops away from the leading pile edge of the delivered sheets;

a spring rod being operably connected to said pressure spring;

a lever, said lever being operably connected between said spring rod and said sheet stops; and means for adjusting the biasing force of said pressure spring.

2. The apparatus according to claim 1, wherein said adjusting means comprises a nut, said nut for being disposed on said spring rod and being adjustable for adjusting the biasing force of said pressure spring.

3. The apparatus according to claim 2, further comprising:

means for arresting said sheet stops, comprising:

a cylinder, said cylinder being actuable via a pressure medium;

a piston rod extending from said cylinder;

a pin being disposed at an extended end of said piston rod; and a roller being disposed on said lever; and said pin being configured for arresting said roller to arrest said sheet stops.

4. The apparatus according to claim 1, wherein said adjusting means comprises a handwheel for adjusting the biasing force of said pressure spring.

5. The apparatus according to claim 4, further comprising:

means for arresting said sheet stops, comprising:

a cylinder, said cylinder being actuable via a pressure medium;

a piston rod extending from said cylinder;

a pin being disposed at an extended end of said piston rod; and a roller being disposed on said lever; and said pin being configured for arresting said roller to arrest said sheet stops.

6. The apparatus according to claim 1, further comprising:

said adjusting means comprises motor means for adjusting the bias of said pressure spring.

7. The apparatus according to claim 6, further comprising:

means for arresting said sheet stops, comprising:

a cylinder, said cylinder being actuable by means of a pressure medium;

a piston rod extending from said cylinder;

a pin being disposed at an extended end of said piston rod; and a roller being disposed on said lever; and said pin being configured for arresting said roller to arrest said sheet stops.

8. The apparatus according to claim 1, further comprising:

means for arresting said sheet stops, comprising:

a cylinder, said cylinder being actuable via a pressure medium;

a piston rod extending from said cylinder;

a pin being disposed at an extended end of said piston rod; and a roller being disposed on said lever; and said pin being configured for arresting said roller to arrest said sheet stops.

9. The apparatus according to claim 8, wherein:

said means for adjusting the biasing force of said pressure spring comprising one of:

a nut being threadedly mounted on said spring rod;

a handweel being operably connected with said spring rod; and motor means being operably connected with said spring rod.

10. The apparatus according to claim 9, further comprising:

an angle bracket and a cam roller being rotatably mounted on said angle bracket, said cam roller being operably engageable with said eccentric cam;

said angle bracket and said control lever both being mounted for pivotal movement about a common pivot point;

said control lever being configured to move pivotally in direct response to the pivotal movement of said angle bracket;

a draw spring being operably connected to a portion of said angle bracket and being configured for maintaining said cam roller in engagement with said eccentric cam;

said lever being mounted for pivotal movement and being configured to move in direct response to the pivotal movement of said control lever;

a roll being mounted at an end of said control lever, said roll being operably engageable with said lever and being configured to serve as an area of contact between said control lever and said lever;

said spindle and said lever being integrally connected with each other and being mounted for pivotal movement about a common pivot point;

said spring rod having opposite ends;

a second cylinder being actuable by a pressurized medium;

a second piston rod extending from said second cylinder;

a second pin being disposed at an extended end of said second piston rod;

said second pin being operably connected with a first of the ends of said spring rod;

said means for adjusting the biasing force of said pressure spring being operably connected to said spring rod at the first end of said spring rod;

a third pin for operably connecting the second, opposite end of said spring rod with said lever;

an intermediate swivel member being connected between said second pin, at the extended end of said second piston rod, and the first end of said spring rod;

said spring rod defining a longitudinal direction thereof along said spring rod between said first end and said second end of said spring rod;

said second cylinder defining a longitudinal direction thereof parallel to said second piston rod, said second piston rod being configured for being extended along the longitudinal direction of said second cylinder;

said intermediate swivel member being configured for displacing said spring rod in the longitudinal direction of said spring rod in response to the extension of said second piston rod; and said lever being configured for pivoting said sheet stops away from the leading pile edge of the delivered sheets in response to the longitudinal displacement of said spring rod.

11. Apparatus for forming a delivery pile at a sheet delivery area of a printing press, the sheet delivery area having sheets delivered thereto sequentially along a line of transport by the printing press, said apparatus comprising:

sheet piling means, said sheet piling means having a sheet receiving surface positioned within a plane and along the line of transport of the delivered sheets;

at least one sheet stop, said at least one sheet stop comprising a sheet stop member extending transversely to said plane within which said sheet receiving surface is positioned, said sheet stop member being displaceable along the line of transport between a first position wherein said sheet stop member is adjacent said sheet receiving surface and a second position wherein said sheet stop member is distanced from said sheet receiving surface;

means for oscillating said at least one sheet stop between said first position and said second position;

a pressure spring for providing a biasing force and biasing said at least one sheet stop along the line of transport in a direction from said second position and towards said first position; and means for adjusting the biasing force of said pressure spring.

12. The apparatus according to claim 11, wherein said oscillating means comprises cam means, said cam means comprising an eccentric cam and a control lever being operably engageable with said eccentric cam.

13. The apparatus according to claim 12, further comprising:

a spindle, said at least one sheet stop being mounted on said spindle; and said control lever being operably engageable with said spindle.

14. The apparatus according to claim 13, wherein said cam means is configured for pulsatingly moving said at least one sheet stop away from the leading pile edge of the delivered sheets.

15. The apparatus according to claim 14, further comprising:

said sheet piling means comprising a piling device for vertically transporting the pile of delivered sheets;

said at least one sheet stop comprising a plurality of sheet stops;

said sheet stops being configured to face in the sheet feeding direction, for arresting the delivery of sheets;

said oscillating means comprising means for moving said sheet stops back and forth for aligning and jogging the delivered sheets;

said means for moving said sheet stops comprising means for forming an exact leading pile edge of the delivered sheets;

said pressure spring comprising means for providing a biasing force and biasing said sheet stops against the leading pile edge of the delivered sheets;

a spring rod being operably connected to said pressure spring;

a lever, said lever being operably connected between said spring rod and said sheet stops;

said adjusting means comprises at least one of:

a nut, said nut for being disposed on said spring rod and being adjustable for adjusting the biasing force of said pressure spring;

a handwheel for adjsuting the biasing force of said pressure spring; and motor means for adjusting the bias of said pressure spring; means for arresting said sheet stops, comprising:

a cylinder, said cylinder being actuable via a pressure medium;

a piston rod extending from said cylinder;

a pin being disposed at an extended end of said piston rod; and a roller being disposed on said lever;

said pin being configured for arresting said roller to arrest said sheet stops;

an angle bracket and a cam roller being rotatably mounted on said angle bracket, said cam roller being operably engageable with said eccentric cam;

said angle bracket and said control lever both being mounted for pivotal movement about a common pivot point;

said control lever being configured to move pivotally in direct response to the pivotal movement of said angle bracket;

a draw spring being operably connected to a portion of said angle bracket and being configured for maintaining said cam roller in engagement with said eccentric cam;

said lever being mounted for pivotal movement and being configured to move in direct response to the pivotal movement of said control lever;

a roll being mounted at an end of said control lever, said roll being operably engageable with said lever and being configured to serve as an area of contact between said control lever and said lever;

said spindle and said lever being integrally connected with each other and being mounted for pivotal movement about a common pivot point;

said spring rod having opposite ends;

a second cylinder being actuable by a pressurized medium;

a second piston rod extending from said second cylinder;

a second pin being disposed at an extended end of said second piston rod;

said second pin being operably connected with a first of the ends of said spring rod;

said means for adjusting the biasing force of said pressure spring being operably connected to said spring rod at the first end of said spring rod;

a third pin for operably connecting the second, opposite end of said spring rod with said lever;

an intermediate swivel member being connected between said second pin, at the extended end of said second piston rod, and the first end of said spring rod;

said spring rod defining a longitudinal direction thereof along said spring rod between said first end and said second end of said spring rod;

said second cylinder defining a longitudinal direction thereof parallel to said second piston rod, said second piston rod being configured for being extended along the longitudinal direction of said second cylinder;

said intermediate swivel member being configured for displacing said spring rod in the longitudinal direction of said spring rod in response to the extension of said second piston rod; and said lever being configured for pivoting said sheet stops away from the leading pile edge of the delivered sheets in response to the longitudinal displacement of said spring rod.

16. Apparatus for forming a delivery pile at a sheet delivery area of a printing press; the sheet delivery area having sheets delivered thereto by the printing press,sequentially and along a line of transport; the delivery pile for having a plurality of sides defined by edges of the delivered sheets; said apparatus comprising:

sheet piling means, said sheet piling means having a sheet receiving surface positioned within a plane and along the line of transport of the delivered sheets, said sheet piling means being configured for the formation thereon of a pile of delivered sheets;

spindle means being rotatable about a longitudinal axis of rotation, the longitudinal axis of rotation extending along an edge of the sheet piling means;

at least one sheet stop, said at least one sheet stop comprising a sheet stop member extending transversely to said plane within which said sheet receiving surface is positioned, said sheet stop member being displaceable along the line of transport between a first position wherein said sheet stop member is adjacent said sheet receiving surface and a second position wherein said sheet stop member is distanced from said sheet receiving surface;

said at least one sheet stop being attached to and extending from said spindle means and along a side of the delivery pile formed on said sheet piling means;

biasing means for biasing said at least one sheet stop along the line of transport in a direction from said second position and towards said first position;

a lever member attached to said spindle means; said lever member being configured for displacing said spindle to displace said at least one sheet stop;

means for oscillating said sheet stop member between said first position and said second position; and said oscillating means comprising:

an eccentrically mounted and rotationally driven cam member;

a control lever being pivotally mounted at a pivot point for pivotal movement thereabout, said control lever being configured for intermittently coming into contact and out of contact with said lever member to pulsatingly move said sheet stops away from and towards the leading pile edge of the delivered sheets.

17. The apparatus according to claim 16, wherein said biasing means comprises a pressure spring for providing a biasing force and biasing said at least one sheet stop against the leading pile edge of the delivered sheets, in the direction from said second position and towards said first position.

18. The apparatus according to claim 17, further comprising means for adjusting the biasing force of said pressure spring.

19. The apparatus according to claim 18, further comprising:

a spring rod being operably connected to said pressure spring; and said lever member being operably connected between said spring rod and said at least one sheet stop.

20. The apparatus according to claim 19, further comprising:

said sheet piling means comprising a piling device for vertically transporting the pile of delivered sheets;

said at least one sheet stop comprising a plurality of sheet stops, said sheet stops being configured to face in the sheet feeding direction, for arresting the delivery of sheets;

said oscillating means being configured for moving said sheet stops back and forth for aligning and jogging the delivered sheets;

said oscillating means being configured for forming an exact leading pile edge of the delivered sheets;

said spindle means comprising a spindle;

said control lever being operably engageable with said cam member;

said adjusting means comprising at least one of:

a nut, said nut for being disposed on said spring rod and being adjustable for adjusting the biasing force of said pressure spring;

a handwheel for adjusting the biasing force of said pressure spring; and motor means for adjusting the bias of said pressure spring; means for arresting said sheet stops, comprising:

a cylinder, said cylinder being actuable via a pressure medium;

a piston rod extending from said cylinder;

a pin being disposed at an extended end of said piston rod; and a roller being disposed on said lever;

said pin being configured for arresting said roller to arrest said sheet stops; an angle bracket and a cam roller being rotatably mounted on said angle bracket, said cam roller being operably engageable with said cam member;

said angle bracket and said control lever member both being mounted for pivotal movement about a common pivot point;

said control lever being configured to move pivotally in direct response to the pivotal movement of said angle bracket;

a draw spring being operably connected to a portion of said angle bracket and being configured for maintaining said cam roller in engagement with said cam member;

said lever member being mounted for pivotal movement and being configured to move in direct response to the pivotal movement of said control lever;

a roll being mounted at an end of said control lever, said roll being operably engageable with said lever member and being configured to serve as an area of contact between said control lever and said lever member;

said spindle and said lever member being integrally connected with each other and being mounted for pivotal movement about a common pivot point;

said spring rod having opposite ends;

a second cylinder being actuable by a pressurized medium;

a second piston rod extending from said second cylinder;

a second pin being disposed at an extended end of said second piston rod;

said second pin being operably connected with a first of the ends of said spring rod;

said means for adjusting the biasing force of said pressure spring being operably connected to said spring rod at the first end of said spring rod;

a third pin for operably connecting the second, opposite end of said spring rod with said lever member;

an intermediate swivel member being connected between said second pin, at the extended end of said second piston rod, and the first end of said spring rod;

said spring rod defining a longitudinal direction thereof along said spring rod between said first end and said second end of said spring rod;

said second cylinder defining a longitudinal direction thereof parallel to said second piston rod, said second piston rod being configured for being extended along the longitudinal direction of said second cylinder;

said intermediate swivel member being configured for displacing said spring rod in the longitudinal direction of said spring rod in response to the extension of said second piston rod; and said lever member being configured for pivoting said sheet stops away from the leading pile edge of the delivered sheets in response to the longitudinal displacement of said spring rod.

* * * * *

UNITED STATES PATENT AND TRADEMARK OFFICE

CERTIFICATE OF CORRECTION

PATENT NO. : 5,226,642

DATED : July 13, 1993

INVENTOR(S) : Udo GANTER

It is certified that error appears in the above-identified patent and that said Letters Patent is hereby corrected as shown below:

In column 4, line 46, after '8 control', delete "level" and insert --lever--.

In column 8, line 33, Claim 15, after 'for', delete "adjsuting" and insert --adjusting--.

Signed and Sealed this

Nineteenth Day of April, 1994

*Attest:*

*Attesting Officer*

Bruce Lehman

BRUCE LEHMAN

*Commissioner of Patents and Trademarks*